United States Patent [19]

Limburg et al.

[11] Patent Number: 4,599,286

[45] **Date of Patent: * Jul. 8, 1986**

[54] PHOTOCONDUCTIVE IMAGING MEMBER WITH STABILIZER IN CHARGE TRANSFER LAYER

[75] Inventors: William W. Limburg, Penfield; Dale S. Renfer, Webster, both of N.Y.

[73] Assignee: Xerox Corporation, Stamford, Conn.

[ * ] Notice: The portion of the term of this patent subsequent to Jan. 7, 2003 has been disclaimed.

[21] Appl. No.: 686,044

[22] Filed: Dec. 24, 1984

[51] Int. Cl.[4] ..... G03G 5/14

[52] U.S. Cl. ..... 430/59

[58] Field of Search ..... 430/59

[56] References Cited

U.S. PATENT DOCUMENTS

| | | | |
|---|---|---|---|
| 3,951,654 | 4/1976 | Mammino | 96/1.6 |
| 4,191,568 | 3/1980 | Ema et al. | 430/66 |
| 4,232,103 | 11/1980 | Limburg et al. | 430/59 |
| 4,256,821 | 3/1981 | Enomoto | 430/59 |
| 4,265,990 | 5/1981 | Stolka et al. | 430/59 |
| 4,361,637 | 11/1982 | Stofko, Jr. et al. | 430/58 |
| 4,365,014 | 12/1982 | Sakai et al. | 430/59 |
| 4,388,392 | 6/1983 | Kato et al. | 430/58 |
| 4,390,609 | 6/1983 | Weidemann | 430/58 |
| 4,397,931 | 8/1983 | Limburg et al. | 430/59 |
| 4,439,507 | 3/1984 | Pan et al. | 430/59 |
| 4,454,212 | 6/1984 | Sekai et al. | 430/59 |
| 4,456,672 | 6/1984 | Eilingsfeld et al. | 430/59 |
| 4,457,994 | 7/1984 | Pai et al. | 430/59 |
| 4,464,450 | 8/1984 | Teuscher | 430/59 |

FOREIGN PATENT DOCUMENTS 2059617 4/1981 United Kingdom .

*Primary Examiner*—Roland E. Martin

*Attorney, Agent, or Firm*—Peter H. Kondo

[57] ABSTRACT

An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

9 Claims, No Drawings

PHOTOCONDUCTIVE IMAGING MEMBER WITH STABILIZER IN CHARGE TRANSFER LAYER

BACKGROUND OF THE INVENTION

This invention relates in general to electrophotography and, more specifically, to a novel electrophotographic imaging member and process for using the imaging member.

In the art of electrophotography, an electrophotographic imaging member containing a photoconductive insulating layer is imaged by first uniformly electrostatically charging the imaging surface of the imaging member. The member is then exposed to a pattern of activating electromagnetic radiation such as light which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the electrode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether)resins are taught in U.S. Pat. No. 4,439,507. The disclosures of the aforesaid U.S. Pat. No. 4,265,990 and U.S. Pat. No. 4,439,507 are incorporated herein in their entirety.

Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. However, when the charge transport layer comprises a film forming resin and one or more of certain diamine compounds, difficulties have been encountered with these photosensitive members when they are used under certain conditions in copiers, duplicators and printers. For example, image deletion bands are observed in the form of a band of deleted print in copy images when an automatic xerographic imaging system is allowed to remain inactive for extended periods of time such as over a long holiday weekend. The severity of the problem appears to be proportional to the number of copies made immediately preceeding shut down and also to the length of time the system is allowed to remain at rest. This image deletion band seems to correspond to the area on the photoreceptor directly below the corotron charging device when the system is in a shut down mode and is believed to be a surface phenomenon which can recover if given a sufficient amount of recovery time.

For enclosed, slower speed systems where the residence time of an incremental segment of the photoreceptor beneath a corotron is greater than for high speed machines, a reduction of contrast potential, increased cycle down and lower initial charges are observed with continued cycling under inadequate ventilation conditions. When cycling down occurs, the surface charge and charge acceptance decrease as the dark decay increases in the areas exposed and the contrast potential for good images degrades and causes faded images. Dark decay is defined as the loss of charge on a photoreceptor in the dark after uniform charging. This is an undesirable fatigue-like problem resulting in lower initial charges that cannot be maintained during image cycling and is unacceptable for automatic electrophotographic copiers, duplicators and printers which require precise, stable, and a predictable photoreceptor operating range. Contrast potential is defined as the difference in potential between the background or light struck areas of a photosensitive member and the unexposed areas of a photosensitive member after exposure to a pattern of activating electromagnetic radiation such as light. Variations in conrast potential can adversely affect copy quality, especially in modern copiers, duplicators and printers which by their very nature require photoreceptor properties to meet precise operating windows. A decline in contrast potential variations can cause copies to not exist at all or appear too light and fuzzy. Moreover, this degradation of the photoreceptor in enclosed, slower speed systems appears to be a bulk phenomenon which is considered to be of a permanent nature. Control of both contrast potential and dark decay of photosensitive members is important not only initially but through the entire cycling life of the photosensitive members.

Although the electrophotographic imaging members described above produce excellent images, usage under certain conditions can cause cycle down and image deletion bands to form. This is particularly evident in electrophotographic imaging members containing charge transport layers comprising aromatic diamine molecules dispersed in a polymer matrix. Thus, the characteristics of photosensitive members comprising a conductive layer and at least two electrically operative layers, one of which is a charge transport layer comprising a film forming resin and one or more aromatic amine compounds, exhibit deficiencies which are undesirable in modern copiers, duplicators, and printers. Accordingly, there is a need for compositions and processes which impart greater stability to electrophotographic imaging systems which undergo periodic cycling.

SUMMARY OF THE INVENTION

It is an object of the invention to provide an electrophotographic imaging member comprising a conductive layer, a charge generation layer and a contiguous charge transport layer, said charge transport layer comprising an aromatic amine charge transport molecule in a continuous polymeric binder phase and a chemical stabilizer selected from the group consisting of I. a nitrone compound having the structural formula

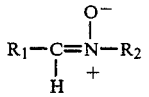

wherein $R_1$ is selected from the group consisting of a substituted and unsubstituted group selected from the group consisting of a phenyl group, a fused ring aromatic group and a heterocyclic group, and $R_2$ is selected from the group consisting of a substututed and unsubstituted group selected from the group consisting of a linear or branched alkyl group containing 1 to 20 carbon atoms, a phenyl group, a fused ring aromatic group and a heterocyclic group, II. an isobenzofuran compound having the structural formula

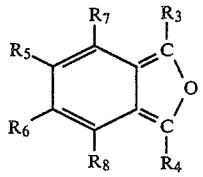

wherein $R_3$, $R_4$, $R_5$, $R_6$, $R_7$ and $R_8$ are independently selected from the group consisting of substituted and unsubstituted alkyl groups containing 1 to 10 carbon atoms and substituted and unsubstituted phenyl groups, III. a hydroxyaromatic compound selected from the group consisting of A. fused hydroxyaromatic compounds having the structural formula

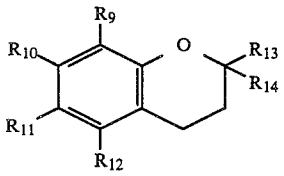

wherein $R_9$, $R_{10}$, $R_{11}$, and $R_{12}$ are independently selected from hydrogen, a hydroxyl group, an alkoxy group containing 1 to 6 carbon atoms, and an alkyl group containing 1 to 6 carbon atoms, wherein at least one of said $R_9$, $R_{10}$, $R_{11}$, and $R_{12}$ is a hydroxyl group, and $R_{13}$ and $R_{14}$ are independently selected from hydrogen, an alkenyl group containing 2 to 40 carbon atoms, and an alkyl group containing 1 to 40 carbon atoms, and B. monomeric and polymeric phenolic compounds having the structural formula

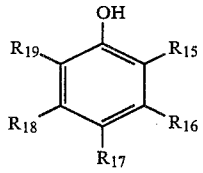

wherein $R_{15}$, $R_{16}$, $R_{17}$, $R_{18}$, and $R_{19}$ are independently selected from hydrogen, a hydroxyl group, and substituted and unsubstituted groups selected from the group consisting of a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, a phenyl group, a napthyl group, an ester group, and an alkoxy group containing 1 to 20 carbon atoms, and C. substituted and unsubsituted naphthol compounds, and mixtures thereof.

This electrophotographic imaging member may be employed in an electrophotographic imaging process.

Generally, an electrophotoconductive member containing a stabilizer compound of this invention comprises at least two electrically operative layers on a supporting substrate. The substrate may be opaque or substantially transparent and may comprise numerous suitable materials having the required mechanical properties.

A conductive layer or ground plane which may comprise the entire supporting substrate or be present as a coating on an underlying member may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thicknesses of from about 50 Angstrom units to many centimeters. When a flexible photoresponsive imaging device is desired, the thickness may be between about 100 Angstrom units to about 750 Angstrom units. The underlying member may be of any conventional material including metal, plastics and the like. Typical underlying members include insulating non-conducting materials comprising various resins known for this purpose including polyesters, polycarbonates, polyamides, polyurethanes, and the like. The coated or uncoated supporting substrate may be flexible or rigid and may have any number of many different configurations such as, for example, a plate, a cylindrical drum, a scroll, an endless flexible belt, and the like. Preferably, the insulating substrate is in the form of an endless flexible belt and comprises a commercially available polyethylene terephthalate polyester known as Mylar available from E. I. du Pont de Nemours & Co.

If desired, any suitable blocking layer may be interposed between the conductive layer and the charge generating layer. A prefered blocking layer comprises a reaction product between a hydrolyzed silane and a metal oxide layer of a conductive anode. The imaging member is prepared by depositing on the metal oxide layer of a metallic conductive anode layer a coating of an aqueous solution of the hydrolyzed silane at a pH between about 4 and about 10, drying the reaction product layer to form a siloxane film and applying an optional adhesive layer, the generating layer, and the charge transport layer to the siloxane film. Typical hydrolyzable silanes include 3-aminopropyl triethoxy silane, (N,N-dimethyl 3-amino) propyl triethoxysilane, N,N-dimethylaminophenyl triethoxy silane, N-phenyl aminopropyl trimethoxy silane, triethoxy silylpropylethylene diamine, trimethoxy silylpropylethylene diamine, trimethoxy silylpropyldiethylene triamine and mixtures thereof.

Generally, dilute solutions are preferred for achieving thin coatings. Satisfactory reaction product films may be achieved with solutions containing from about 0.1 percent by weight to about 1.5 percent by weight of the silane based on the total weight of the solution.

Any suitable technique may be utilized to apply the hydrolyzed silane solution to the metal oxide layer of a metallic conductive layer. Typical application techniques include spraying, dip coating, roll coating, wire wound rod coating, and the like. Generally, satisfactory results may be achieved when the reaction product of the hydrolyzed silane and metal oxide layer forms a layer having a thickness between about 20 Angstroms and about 2,000 Angstroms.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. This siloxane coating is described in U.S. Pat. No. 4,464,450, entitled "Multi-layer Photoreceptor Containing Siloxane on a Metal Oxide Layer", the disclosure of this patent being incorporated herein in its entirety.

In some cases, intermediate layers between the blocking layer and the adjacent charge generating or photogenerating material may be desired to improve adhesion or to act as an electrical barrier layer. If such layers are utilized, they preferably have a dry thickness between about 0.1 micrometer to about 5 micrometers. Typical adhesive layers include film-forming polymers such as polyester, polyvinylbutyral, polyvinylpyrolidone, polyurethane, polymethyl methacrylate and the like.

Any suitable charge generating or photogenerating material may be employed in one of the two electrically operative layers in the multilayer photoconductor prepared by the process of this invention. The light absorbing photogeneration layer may contain organic photoconductive pigments and/or inorganic photoconductive pigments. Typical organic photoconductive pigments include vanadyl phthalocyanine and other phthalocyanine compounds, metal-free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, squaraine pigments, polynuclear aromatic quinones available from Allied Chemical Corporation under the tradename Indofast Double Scarlet, Indofast Violet Lake B, Indofast Brilliant Scarlet and Indofast Orange, thiopyrylium pigments, and the like. Typical inorganic photosensitive pigments include amorphous selenium, trigonal selenium, mixtures of Groups IA and IIA elements, $As_2Se_3$, selenium alloys, cadmium selenide, cadmium sulfo selenide, copper and chlorine doped cadmium sulfide, trigonal selenium doped with sodium carbonate as described in U.S. Pat. Nos. 4,232,102 and 4,233,283, and the like. Other examples of charge generator layers are disclosed in U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable resin binder material may be employed in the charge generator layer. Typical organic resinous binders include polycarbonates, acrylate polymers, vinyl polymers, polyvinylcarbazole, polyesters, polysiloxanes, polyamides, polyurethanes, epoxies, and the like. If desired, the organic resinous binders may contain other suitable additives. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers.

The photogenerating layer containing photoconductive compositions and/or pigments, and the resinous binder material generally ranges in thickness of from about 0.1 micrometer to about 5.0 micrometers, and preferably has a thickness of from about 0.3 micrometer to about 3 micrometers. Generally, the maximum thickness of this layer is dependent on factors such as mechanical considerations, while the minimum thickness of this layer is dependent on for example, the pigment particle size, optical density of the photogenerating pigment, and the like. Thicknesses outside these ranges can be selected providing the objectives of the present invention are achieved.

The photogenerating composition or pigment is present in the resinous binder composition in various amounts, generally, however, from about 5 percent by weight to about 80 percent by weight, and preferably in an amount of from about 10 percent by weight to about 50 percent by weight. Accordingly, in this embodiment the resinous binder is present in an amount of from about 95 percent by weight to about 20 percent by weight, and preferably in an amount of from about 90 percent by weight to about 50 percent by weight. The specific proportions selected depends to some extent on the thickness of the generator layer.

Other typical photoconductive layers include amorphous or alloys of selenium such as selenium-arsenic, selenium-tellurium-arsenic, and selenium-tellurium.

The preferred charge transport layer employed in one of the two electrically operative layers of the multilayered or composite photoconductor prepared by the process of this invention comprises about 25 to about 75 percent by weight of at least one charge transporting aromatic amine compound or hydrazone derivative, about 75 to about 25 percent by weight of an polymeric film forming resin in which the charge transporting compound is homogeneously dispersed, and optionally about 1 to about 10,000 parts per million based on the weight of the charge transporting compound of protonic acid or Lewis acid soluble in a suitable solvent such as methylene chloride. The charge transport layer generally has a thickness in the range of from about 5 to about 50 micrometers, and preferably a thickness of from about 10 to about 40 micrometers.

The aromatic amine compound may be of one or more compounds having the general formula:

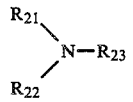

wherein $R_{21}$ and $R_{22}$ are an aromatic group selected from the group consisting of a substituted or unsubstituted phenyl group, naphthyl group, and polyphenyl group and $R_{23}$ is selected from the group consisting of a substituted or unsubstituted aryl group, alkyl group having from 1 to 18 carbon atoms and cycloaliphatic compounds having from 3 to 18 carbon atoms or a hydrazone molecule having the general formula:

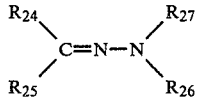

wherein $R_{24}$, $R_{25}$, $R_{26}$ and $R_{27}$ are selected from the group consisting of hydrogen, substituted or unsubstituted phenyl group, naphthyl group, carbazoyl group, biphenyl group, diphenyl ether group, alkyl group having 1 to 18 carbon atoms, and cycloaliphatic group having 1 to 18 carbon atoms.

A preferred aromatic amine compound has the general formula:

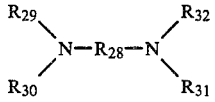

wherein $R_{28}$ is selected from the group consisting of a substituted or unsubstituted phenyl group, biphenyl group, diphenyl ether group, alkyl group having from 1 to 18 carbon atoms, and cycloaliphatic group having from 3 to 12 carbon atoms and $R_{29}$, $R_{30}$, $R_{31}$ and $R_{32}$ are an aromatic group selected from the group consisting of substituted or unsubstituted phenyl group, napthyl group and polyphenyl group. The substituents should be free from electron withdrawing groups such as $NO_2$ groups, CN groups, and the like. Generally these aromatic amines have an ionization potential of below about 7.7 e.v.

Examples of charge transporting aromatic amines represented by the structural formula above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more the aromatic diamine compounds described above, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Any suitable inactive resin binder soluble in methylene chloride or other suitable solvent may be employed in the process of this invention. This inert highly insulating resinous binder, which has a resistivity of at least about $10^{12}$ ohm-cm to prevent undue dark decay, is a material which is not necessarily capable of supporting the injection of holes from the photogenerator layer. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The stabilizing materials effective for this application are multiactive, that is, they exhibit the ability to deactivate a range of degradative species such as free radicals, oxidizing agents and singlet oxygen (quenches with turnover numbers greater than about 1). Generally, the classes of materials exhibiting this activity that would be useful in the electrophotographic imaging members of this invention are selected from the following groups:

I. a nitrone compound having the structural formula

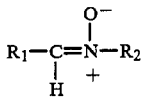

wherein $R_1$ is selected from the group consisting of a substituted and unsubstituted group selected from the group consisting of a phenyl group, a fused ring aromatic group and a heterocyclic group, and $R_2$ is selected from the group consisting of a substituted and unsubstituted group selected from the group consisting of a linear or branched alkyl group containing 1 to 20 carbon atoms, a phenyl group, a fused ring aromatic group and a heterocyclic group, II. an isobenzofuran compound having the structural formula

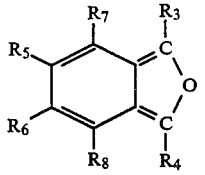

wherein $R_3$, $R_4$, $R_5$, $R_6$, $R_7$ and $R_8$ are independently selected from the group consisting of substituted and unsubstituted alkyl groups containing 1 to 10 carbon atoms and substituted and unsubstituted phenyl groups, III. a hydroxyaromatic compound selected from the group consisting of A. fused hydroxyaromatic compounds having the structural formula

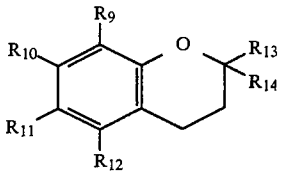

wherein $R_9$, $R_{10}$, $R_{11}$, and $R_{12}$ are independently selected from hydrogen, a hydroxyl group, an alkoxy group containing 1 to 6 carbon atoms, and an alkyl group containing 1 to 6 carbon atoms, wherein at least one of said $R_9$, $R_{10}$, $R_{11}$, and $R_{12}$ is a hydroxyl group, and $R_{13}$ and $R_{14}$ are independently selected from hydrogen, an alkenyl group containing 2 to 40 carbon atoms, and an alkyl group containing 1 to 40 carbon atoms, and B. monomeric and polymeric phenolic compounds having the structural formula

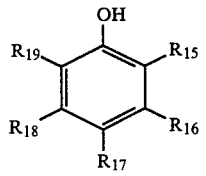

wherein $R_{15}$, $R_{16}$, $R_{17}$, $R_{18}$, and $R_{19}$ are independently selected from hydrogen, a hydroxyl group, and substituted and unsubstituted groups selected from the group consisting of a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, a phenyl group, a napthyl group, an ester group, and an alkoxy group containing 1 to 20 carbon atoms, and C. substituted and unsubstituted naphthol compounds, and mixtures thereof.

Typical nitrones include t-butylphenylnitrone (also called N-tertbutyl-alpha-phenylnitrone), i-propylphenylnitrone, 4-methylphenylphenylnitrone, t-butyl-4-methylphenylnitrone, and the like.

Typical isobenzofurans include diphenylisobenzofuran, dimethyl isobenzofurans, diethyl isobenzofurans, dipropyl isobenzofurans, diisopropyl isobenzofurans, dibutyl isobenzofurans, diisobutyl isobenzofurans, diphenyl isobenzofurans, alkyl substituted phenyl isobenzofurans in which the alkyl group contains from 1 to 4 carbon atoms, di(p-chlorophenyl) isobenzofuran, di(p-cyanophenyl) isobenzofuran, and the like.

Typical fused hydroxyaromatic compounds include alpha-tocopherol, [2,5,7,8-tetramethyl-2-(4',8',12'-trimethyltridecyl)-6-chromanol] and isomers thereof, beta-tocopherol[3,4-dihydro-2,5,8-trimethyl-2-(4,8,12-trimethyltridecyl)-2H-1-benzopyran-6-ol], gamma-tocopherol[3,4-dihydro-2,7,8-trimethyl-2-(4,8,12-trimethyltridecyl)-2H-1-benzopyran-6-ol]deltatocopherol[3,4-dihydro-2,8-dimethyl-2-(4,8,-12-trimethyltridecyl)-2H-1-benzopyran-6-ol], epsilon-tocopherol[3,4-dihydro-2,5,8-tetramethyl-2-(4,8,12-trimethyl-3,7,11-tridecatrienyl)-2H-1-benzopyran-6-ol], zeta$_1$-tocopherol[3,4-dihydro-2,5,7,8-tetramethyl-2-(4,8,12-trimethyl-3,7,11-tridecatrienyl)-2H-1-benzopyran-6-ol], zeta$_2$-tocopherol[3,4-dihydro-2,5,7-trimethyl-2-(4,8,12-trimethyltridecyl)-2H-1-benzopyran-6-ol], etatocopherol, tocol[3,4-dihydro-2-methyl-2-(4,8,12-trimethyltridecyl)-2H-1-benzopyran-6-ol], and the like and mixtures thereof.

Typical phenolic compounds include 2-tert-butyl-4-methoxyphenol, 2,6-di-t-butyl-4-methoxyphenol, hydroquinones, 2,6-di-tert-butyl-4-ethoxyphenol, 2,6-di-tert-butylphenol, 2,5-di-t-butyl-4-methoxyphenol, 2,6-di-t-butyl-p-cresol, 2,4,6-triphenylphenol, erythrityl tetrakis[beta-(4-hydroxy,3,5-di-t-butylphenyl)propionate], and the like and mixtures thereof.

Typical substituted and unsubstituted napthol compounds include 1-hydroxy-4-methyl-8-tert-butyl naphthalene, 1-hydroxy-4-ethyl-8-tert-butyl naphthalene, 1-hydroxy-4-propyl-8-tert-butyl naphthalene, 1-hydroxy-4-butyl-8-tert-butyl naphthalene, 1-hydroxy-4-methoxy-8-tert-butyl naphthalene, 1-hydroxy-4-ethoxy-8-tert-butyl naphthalene, 1-hydroxy-4-propoxy-8-tert-butyl naphthalene, 1-hydroxy-4-butoxy-8-tert-butyl naphthalene, 1-hydroxy-2-tert-butyl-4-methyl naphthalene, 1-hydroxy-2-tert-butyl-4-ethyl naphthalene, 1-hydroxy-2-tert-butyl-4-propyl naphthalene, 1-hydroxy-2-tert-butyl-4-butyl naphthalene, 1-hydroxy-2-tert-butyl-4-methoxy naphthalene, 1-hydroxy-2-tert-butyl-4-ethoxy naphthalene, 1-hydroxy-2-tert-butyl-4-propoxy naphthalene, 1-hydroxy-2-tert-butyl-4-butoxy naphthalene, 1-hydroxy-2,8-di-tert-butyl-4-methyl naphthalene, 1-hydroxy-2,8-di-tert-butyl-4-ethyl naphthalene, 1-hydroxy-2,8-di-tert-butyl-4-propyl naphthalene, 1-hydroxy-2,8-di-tert-butyl-4-butyl naphthalene, 1-hydroxy-2,8-di-tert-butyl-4-methoxy naphthalene, 1-hydroxy-2,8-di-tertbutyl-4-ethoxy naphthalene, 1-hydroxy-2,8-di-tert-butyl-4-propoxy naphthalene, 1-hydroxy-2,8-di-tert-butyl-4-butoxy naphthalene, and the like and mixtures thereof.

Diphenylisobenzene furan, alpha tocopherol, tetrakis [beta-(4-hydroxy,3,5-di-t-butylphenyl)propionate] (Irganox 1010), and tertbutylphenylnitrone are preferred stabilizers because they are non-toxic, stable at the temperatures normally employed during photoreceptor manufacture, soluble in the preferred transparent binders, readily available and inexpensive.

Satisfactory results may be achieved when the transport layer contains from about 0.01 percent by weight to about 5 percent by weight of the stabilizer based on the total weight of the transport layer dissolved in the continuous binder phase. When less than about 0.01 percent by weight is employed, print deletion and poor contrast in the final copy is observed when imaged after rest exposure of the photoreceptor under a corotron following image cycling or after extended exposure of photoreceptor moving under a corotron. Residual voltage build-up and higher background toner deposits due to increased cycle-up may occur when the stabilizer content exceeds about 5 percent by weight of the stabilizer based on the total weight of the transport layer. Preferably, the transport layer contains from about 0.05 percent by weight to about 2 percent by weight of the stabilizer based on the total weight of the transport layer.

These stabilizers should be soluble in the transport layer binder and transport layer binder solvent. The stabilizers also should not adversely affect the electrical and physical properties of the electrophotographic imaging member. Thus, such stabilizers should not themselves modify the electrical properties of the transport layer material or of any of the other layers present in the electrophotographic imaging member. Additionally, when selecting the stabilizing additive of this invention, it is important that these materials do not introduce conducting states in the layer as a result of any chemical reactions. Additionally, the stabilizer additives of the present invention should be selected so as to not react with other components in the electrophotographic imaging member. Moreover, the stabilizers should not introduce any charge carrier traps into the photoreceptor layers because such introduction will cause deterioration of the photoresponsve properties.

It is believed that the print deletion bands are caused by corotron byproducts interacting with the photoreceptor surface region rendering it conductive. The conductive region causes a band of print deletion or fuzzy images across the surface of the photoreceptor in electrophotographic machines. In certain machine designs, this band is especially prominent in that area of the photoreceptor which is parked under corona charging devices. These charging devices presumably outgas chemical agents which destructively react with the photoresponsive device. This electrically conductive region contains free positive charged material that are probably by-products of the diamine compound and negative counter charges. When the device containing the deletion band is charged with a positive charge, free positive charges from the damaged surface region are injected into the photographic imaging member thereby lowering the charge acceptance of the affected region. If on the other hand the electrophotographic imaging member is charged with a negative charge, the surface is rendered conductive causing loss of contrast potential (blurred images) or lateral conductivity to a ground strip or grounding plane.

In comparison tests, a dicorotron charging device was preconditioned by operating it at the equivalent of several thousand xeorgraphic copies. Multilayered electrophotographic imaging members with and without the stabilizer of this invention were exposed in the center of the imaging surface of each member by a dicorotron charging device at rest. The exposed segment of the imaging members without the stabilizer of this invention was not able to hold positive charges whereas the stabilized electrophotographic imaging member clearly held positive charge and was essentially unaffected by chemical electrical degradation to the extent that it provided prints without deletion. Moreover, even after 70 hours following exposure, the unstabilized control electrophotographic imaging member remained severely damaged and had not adequately recovered.

Thus, such an unstabilized photoreceptor would be undesirable for an automatic electrophotographic copier, duplicator, or printer because of the necessity to frequently replace the photoreceptor in machines operating under these conditions. Similar results were obtained for other corona charging devices such as pin charging devices.

Although the chemical effects of agents apparently produced by a corotron device can be mitigated by moving air through the corona device housing, such a partial solution is accompanied by numerous disadvantages. For example, the air flow exacerbates dirt problems and its associated maintenance requirements. Moreover, this type of air flow requires ozone filtration of the air ejected from the machine when the corotron is in operation. Devices to effect air flow also undesirably increase power consumption and heat generation. In addition, the extra equipment and controls to blow air through the corotron charging device housing increases machine size, complexity and costs. Also, the added equipment contributes to an increased noise level produced by the machine. Further, air flow is unlikely to totally eliminate the corona chemical effects on a photoreceptor to achieve maximum service life. Thus, there is a need for a photographic imaging member which is resistent to the effects of chemical degradation. Utilizing electrophotographic imaging members of this invention minimizes the deletion induced by corona charging devices.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 to about 100 microns, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, about 0.15 percent by weight stabilizer and about 83 percent by weight methylene chloride.

In some cases, intermediate layers between the blocking layer or conductive layer and the adjacent generator transport layer may be desired to improve adhesion or to act as an electrical barrier layer. If such layers are utilized, the layers preferably have a dry thickness between about 0.1 micron to about 5 microns. Typical adhesive layers include film-forming polymers such as polyester, polyvinylbutyral, polyvinylypyrolidone, polyurethane, polymethyl methacrylate and the like.

Optionally, an overcoat layer may also be utilized to improve resistance to abrasion. These overcoating layers may comprise organic polymers or inorganic polymers that are electrically insulating or slightly semiconductive.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoreceptive device was prepared by providing an aluminized polyester substrate (Mylar, available from E. I. du Pont de Nemours & Co.) having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer. This blocking layer was thereafter coated with a polyester (du Pont 49,000, available from E. I. du Pont de Nemours & Co.) adhesive layer coated to a dry thickness of 0.05 micrometers. The adhesive layer coating solution was prepared from 0.5 gram polyester, 60 grams tetrahydrofuran and 39.5 grams cyclohexane and applied with a 0.5 mil Bird applicator. A photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive layer with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1-biphenyl-4,4'-diamine and Makrolon®, a polycarbonate resin having a molecular weight of from about 50,000 to 100,000 (available from Larbensabricken Bayer A.G.). The resulting mixture was dissolved in 15 percent by weight untreated methylene chloride. This solution was applied on the photogenerator layer using a Bird applicator to form a coating which upon drying had a thickness of 25 microns. The resulting photoreceptor device containing all of the above layers was annealed at 135° C. in a forced air oven for 6 minutes. Except for the addition of a stabilizer, the procedures described in this Example were used to prepare the photoreceptors described in the Examples below.

EXAMPLE II

The multilayered electrophotographic photoreceptors having two electrically operative layers as described in Example I were prepared using the same procedures and materials except that about 1.0 percent by weight alpha-tocopherol based on the total weight of the of charge transport layer was added to the amber glass bottle.

EXAMPLE III

Photoreceptors having two electrically operative layers as described in Example I were prepared using the same procedures and materials except that about 1.0 percent by weight diphenylisobenzofuran based on the total weight of the of charge transport layer was added to the amber glass bottle.

EXAMPLE IV

Photoreceptors having two electrically operative layers as described in Example I were prepared using the same procedures and materials except that about 1.0 percent by weight t-butylphenylnitrone based on the total weight of the of charge transport layer was added to the amber glass bottle.

EXAMPLE V

A dicorotron charging device from a Xerox 1075® copier was preconditioned for 8 hours by running at 28 microamps, 6,000 volts, with a positive plate bias. The dicorotron was then turned off and the stationary multilayered electrophotographic imaging members of Examples I, II and III were exposed in the center area by placing the dicorotron charging device in contact with the electrophotographic imaging member. Flanking each side of this exposed area were non-exposed segments of the electrophotographic imaging members. After 28 hours of exposure to the dicorotron, the exposed segment of the photoreceptor of Example I could only be charged to about +178 volts whereas the stabilized electrophotographic imaging member of Examples II and III could be charged to about +800 volts and were essentially unaffected by chemical and electrical degradation to the extent that they provide prints without deletion.

EXAMPLE VI

A dicorotron charging device was preconditioned for 1.5 days by operating it at 28 microamps, 6,000 volts, with a positive plate bias and spaced 0.2 millimeter from a grounded aluminum plate. Each of the multilayered electrophotographic imaging members of Examples I, II, III and IV were exposed in a center area by the dicorotron charging device situated 0.2 millimeter above the electrophotographic imaging member surface for 2.5 days. Flanking each side of this exposed area were non-exposed segments of the electrophotographic imaging members. The test device was alternately run for 1.5 days and shut down (the dicorotron was turned off and the imaging members were stopped) for 2.5 days during the test. The exposed electrophotographic imaging members were then placed on a reciprocating xerographic flat plate scanner fitted out with an elecrometerr to measure surface potential. The forward scan recovery values are based on charge acceptance measurements as shown in the table below which were taken immediately after charging and the reverse scan recovery values are based on the remaining charge 2.6 seconds after charging, as shown in the table below. Charge acceptance after 0, 2, 24, and 70 hours following initiation of the test were measured for the exposed and unexposed areas of the photoreceptors and the recovery values are expressed in terms of a percentage which is calculated by dividing the charge acceptance value of the area exposed to the dicorotron by the value of the area not exposed to the corotron and then multiplying by 100. The results are tabulated in the table below.

| t (hr.) | 0 | 2 | 24 | 70 |
|---|---|---|---|---|
| PERCENT RECOVERY FORWARD SCAN (Measurement taken immediately after charging) | | | | |
| Exp. I (Control) | 0 | 2.2 | 24 | 70 |
| Exp. II | 69 | 77 | 91 | 95 |
| Exp. III | 79 | 82 | 81 | 97 |
| Exp. IV | 58 | 66 | 85 | 96 |
| PERCENT RECOVERY REVERSE SCAN (Measurement taken 2.6 sec. after charging) | | | | |
| Exp. I (Control) | 0 | 0 | 8 | 29 |
| Exp. II | 35 | 50 | 75 | 87 |
| Exp. III | 32 | 52 | 66 | 86 |
| Exp. IV | 18 | 28 | 59 | 83 |

The data in the table above clearly illustrate the rate of recovery of dicorotron damaged electrophotographic imaging members. These data indicate that even 70 hours after exposure, the unstabilized control electrophotographic imaging member remains severely damaged and has not adequately recovered.

EXAMPLE VII

Fresh multilayered electrophotographic imaging members prepared as described in Examples I, II, and III. In order to demonstrate the effectiveness of the stabilizers of Examples II, and III within a reasonable time, the members were cycled under stress conditions which maximized the electrophotographic imaging member exposure to corona chemicals. Thus, a slow speed of about five inches per second for a long residence time under the charging device was employed with no air flow through the charging device and enclosure of the entire test rig to allow little or no air exchange. The corona charging device employed was operated at −6.3 kv in a constant voltage mode. Each of the multilayered electrophotographic imaging members prepared as described in Examples I, II, and III were xerographically cycled at a process speed of 5 inches per second. The electrophotographic imaging member samples were monitored during cycling by elecrostatic probes and the data stored and processed in a computer. This type of condition simulates the environment of a low volume, low cost copier. Contrast potential was compared as a function of the number of cycles. These data were obtained for tests involving three 5,000 cycle bursts followed by a final 10,000 cycle burst during testing at 70° F. at 40% relative humidity. At the beginning of the final 10,000 cycle burst, the contrast potentials for the Examples I (control), II and III were 475, 480 and 505, respectively. At the end of the final 10,000 cycle burst, the contrast potentials for the Examples I (control), II and III were 310, 450 and 445, respectively. These tests clearly illustrate that the stabilized electrophotographic imaging members of this invention have a far greater contrast potential than the control electrophotographic imaging members. In addition, the stabilized electrophotographic imaging members of this invention initially accepted higher than the control members and maintained the higher charging potential throughout the test.

EXAMPLE VIII

The test procedures of Example VII were repeated with fresh multilayered electrophotographic imaging members prepared as described in Examples I, II, and III and the photoinduced discharge charateristics were measured for the final 10,000 cycles. In comparing the photoinduced discharge charateristics of the multilayered electrophotographic imaging member prepared as described in Example I (control) with the multilayered electrophotographic imaging members prepared as described in Examples II and III, the photoinduced discharge curve of Example I exhibited a steady decrease in charge acceptance as evidenced by non-superimposable discharge curves. Both of the electrophotographic imaging members prepared as described in Examples II and III not only exhibited initially better charge acceptance but also showed a slight change in charge acceptance as evidenced by a smaller deviation of subseqent discharge curves from that initially obtained. These results clearly demonstrated that the stabilized electrophotographic imaging members of this invention cycled down far less than the control members.

EXAMPLE IX

Fresh multilayered electrophotographic imaging members prepared as described in Examples I and IV. In order to demonstrate the effectiveness of the stabilizers of Example IV within a reasonable time, the members were cycled under stress conditions which maximized the electrophotographic imaging member exposure to corona chemicals. Thus, a slow speed of about five inches per second for a long residence time under the charging device was employed with no air flow through the charging device and enclosure of the entire test rig to allow little or no air exchange. The corona charging device employed was operated at −6.3 kilovolts in a constant voltage mode. Each of the multilayered electrophotographic imaging members prepared as described in Examples I and IV were xerographically cycled. The electrophotographic imaging member samples were monitored during cycling by electrostatic probes and the data stored and processed in a computer. This type of condition simulates the environment of a low volume, low cost copier. Contrast potential was compared as a function of the number of cycles. These data were obtained for tests involving four 5,000 cycle bursts followed by a final 10,000 cycle burst during testing at 70° F. at 10–15% relative humidity. At the beginning of the final 10,000 cycle burst, the contrast potentials for the Examples I (control) and IV were 425 and 515, respectively. At the end of the final 10,000 cycle burst, the contrast potentials for the Examples I (control) and IV were 240 and 370, respectively. These tests clearly illustrate that the stabilized electrophotographic imaging members of this invention have a far greater contrast potential than the control electrophotographic imaging members. In addition, the stabilized electrophotographic imaging members of this invention accepted initial charges higher than the control members and maintained the higher charging potential throughout the test.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrophotographic imaging member comprising a conductive layer, a charge generation layer and a charge transport layer, said charge transport layer comprising an aromatic amine charge transport molecule in a continuous polymeric binder phase and from about 0.01 percent by weight to about 5 percent by weight based on the total weight of said transport layer of a chemical stabilizer selected from the group consisting of I. a nitrone compound having the structural formula

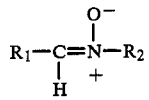

wherein $R_1$ is selected from the group consisting of a substituted and unsubstituted group selected from the group consisting of a phenyl group, a fused ring aromatic group and a heterocyclic group, and $R_2$ is selected from the group consisting of a substituted and unsubstituted group selected from the group consisting of a linear or branched alkyl group containing 1 to 20 carbon atoms, a phenyl group, a fused ring aromatic group and a heterocyclic group, II. an isobenzofuran compound having the structural formula

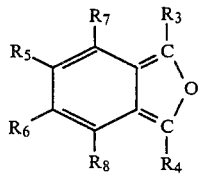

wherein $R_3$, $R_4$, $R_5$, $R_6$, $R_7$ and $R_8$ are independently selected from the group consisting of substituted and unsubstituted alkyl groups containing 1 to 10 carbon atoms and substituted and unsubstituted phenyl groups, III. a hydroxyaromatic compound selected from the group consisting of A. fused hydroxyaromatic compounds having the structural formula

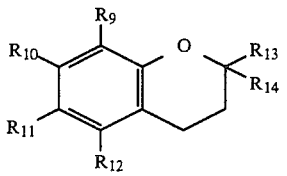

wherein $R_9$, $R_{10}$, $R_{11}$, and $R_{12}$ are independently selected from the groupm consisting of hydrogen, a hydroxyl group, a alkoxy group containing 1 to 6 carbon atoms, and an alkyl group containing 1 to 6 carbon atoms, wherein at least one of said $R_9$, $R_{10}$, $R_{11}$, and $R_{12}$ is a hydroxyl group, and $R_{13}$ and $R_{14}$ are independently selected from the group consisting of hydrogen, an alkenyl group containing 2 to 40 carbon atoms, and an alkyl group containing 1 to 40 carbon atoms, and B. monomeric and polymeric phenolic compounds having the structural formula

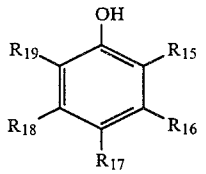

wherein $R_{15}$, $R_{16}$, $R_{17}$, $R_{18}$, and $R_{19}$ aare independently selected from the group conssisting of hydrogen, a hydroxyl group, and substituted and unsubstituted groups selected from the group consisting of a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, a phenyl group, a napthyl group, and C. substituted and unsubstituted naphthol compounds, and mixtures thereof.

2. An electrophotographic imaging member according to claim 1 wherein said stabilizer is t-butylphenylnitrone.

3. An electrophotographic imaging member according to claim 1 wherein said stabilizer is diphenylisobenzofuran.

4. An electrophotographic imaging member according to claim 1 wherein said fused hydroxyaromatic compound is alpha-tocopherol.

5. An electrophotographic imaging member according to claim 1 wherein said phenolic compound is selected from the group consisting of 2,6-di-tert-butylphenol, 2,6-di-tert-butyl-4-methoxyphenol, 2,6-di-tert-butyl-4-methylphenol, 2-tert-butyl-4-methoxyphenol, erythrityl tetrakis[beta-(4-hydroxy-3,5-di-tert-butylphenyl)propionate] and mixtures thereof.

6. An electrophotographic imaging member according to claim 1 wherein said transport layer comprises from about 0.05 percent by weight to about 2 percent by weight of the stabilizer based on the total weight of said transport layer.

7. An electrophotographic imaging member according to claim 1 wherein said aromatic amine charge transport molecule has the general formula:

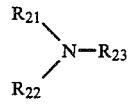

wherein $R_{21}$ and $R_{22}$ are an aromatic group selected from the group consisting of a substituted or unsubstituted phenyl group, naphthyl group, and polyphenyl group and $R_{23}$ is selected from the group consisting of a substituted or unsubstituted aryl group, alkyl group having from 1 to 18 carbon atoms and cycloaliphatic compounds having from 3 to 18 carbon atoms.

8. An electrophotographic imaging process comprising providing an electrophotographic imaging member comprising a conductive layer, a charge generation layer and a charge transport layer, said charge transport layer comprising an aromatic amine charge transport molecule in a continuous polymeric binder phase and from about 0.01 percent by weight to about 5 percent by weight based on the total weight of said transport layer of a chemical stabilizer selected from the group consisting of I. a nitrone compound having the structural formula

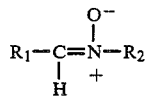

wherein $R_1$ is selected from the group consisting of a substituted and unsubstituted group selected from the group consisting of a phenyl group, a fused ring aromatic group and a heterocyclic group, and $R_2$ is selectes from the group consisting of a substituted and unsubstituted group selected from the group consisting of a linear or branched alkyl group containing 1 to 20 carbon atoms, a phenyl group, a fused ring aromatic group and a heterocyclic group, II. an isobenzofuran compound having the structural formula

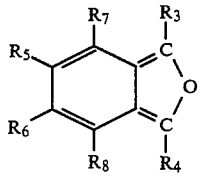

wherein $R_3$, $R_4$, $R_5$, $R_6$, $R_7$ and $R_8$ are independently selected from the group consisting of substituted and unsubstituted alkyl groups containing 1 to 10 carbon atoms and substituted and unsubstituted phenyl groups, III. a hydroxyaromatic compound selected from the group consisting of A. fused hydroxyaromatic compounds having the structural formula

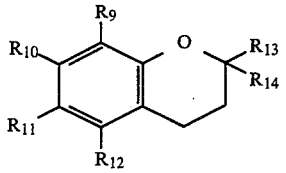

wherein $R_9$, $R_{10}$, $R_{11}$, and $R_{12}$ are independently selected from the groupm consisting of hydrogen, a hydroxyl group, an alkoxy group containing 1 to 6 carbon atoms, and an alkyl group containing 1 to 6 carbon atoms, wherein at least one of said $R_9$, $R_{10}$, $R_{11}$, and $R_{12}$ is a hydroxyl group, and $R_{13}$ and $R_{14}$ are independently selected from the group consisting of hydrogen, an alkenyl group containing 2 to 40 carbon atoms, and an alkyl group containing 1 to 40 carbon atoms, and B. monomeric and polymeric phenolic compounds having the structural formula

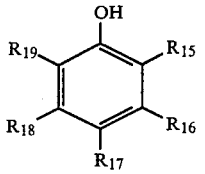

wherein $R_{15}$, $R_{16}$, $R_{17}$, $R_{18}$, and $R_{19}$ are independently selected from the group conssisting of hydrogen, a hydroxyl group, and substituted and unsubstituted groups selected from the group consisting of a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, a phenyl group, a napthyl group, an ester group, and an alkoxy group containing 1 to 20 carbon atoms, and C. substituted and unsubstituted naphthol compounds, and mixtures thereof, forming an electrostatic latent image on said electrophotographic imaging member, contacting said electrostatic latent image with electrostatically attractable toner particles to form a deposited toner image in image configuration and transfering said toner image to a receiving member.

9. An electrophotographic imaging process according to claim 8 comprising repeating said electrostatic latent image forming, toner particles contacting, and toner image transfering steps in a corona generated species rich environment.

* * * * *